US008851265B2

(12) United States Patent
Morishita et al.

(10) Patent No.: US 8,851,265 B2
(45) Date of Patent: Oct. 7, 2014

(54) REVERSE VENDING MACHINE

(75) Inventors: Kazuo Morishita, Fort Lee, NJ (US); Daniel Chung, Wayne, NJ (US)

(73) Assignee: RecycleTech Corporation, Elmwood Park, NJ (US)

( * ) Notice: Subject to any disclaimer, the term of this patent is extended or adjusted under 35 U.S.C. 154(b) by 550 days.

(21) Appl. No.: 12/984,671

(22) Filed: Jan. 5, 2011

(65) Prior Publication Data

US 2012/0173014 A1 Jul. 5, 2012

(51) Int. Cl.
*G07F 7/06* (2006.01)
*B28B 3/02* (2006.01)

(52) U.S. Cl.
CPC ..... *B28B 3/02* (2013.01); *G07F 7/0609* (2013.01)
USPC ..... 194/208

(58) Field of Classification Search
USPC ..... 194/205, 208, 209, 212; 209/522, 523, 209/524, 528, 529; 700/215
See application file for complete search history.

(56) References Cited

U.S. PATENT DOCUMENTS

| | | | | | |
|---|---|---|---|---|---|
| RE27,643 | E | * | 5/1973 | Myers | 194/208 |
| 4,519,306 | A | * | 5/1985 | LaBarge et al. | 100/35 |
| 5,461,972 | A | * | 10/1995 | Tahkanen | 100/45 |
| 5,469,783 | A | * | 11/1995 | Fry | 100/49 |
| 5,630,493 | A | * | 5/1997 | DeWoolfson et al. | 194/209 |
| 6,438,696 | B1 | * | 8/2002 | Baran et al. | 726/22 |
| 2006/0163028 | A1 | * | 7/2006 | Hunscher | 194/209 |
| 2011/0238598 | A1 | * | 9/2011 | Borowski et al. | 705/500 |

* cited by examiner

*Primary Examiner* — Mark Beauchaine
(74) *Attorney, Agent, or Firm* — Marc D. Lowy

(57) ABSTRACT

The present invention is a reverse vending machine which accepts non-metallic and metallic beverage containers for processing. The beverage containers are inserted by the user into an intake chute, where they are then compacted, sorted, and deposited in storage bins contained in the machine. A number of additional functions are provided by the reverse vending machine, including a self cleaning system, a video screen for displaying information to users, a bar code scanner for scanning bar codes, a user ID reader, and a coupon printer for issuing coupons to users. All transaction information is processed by a computer and stored electronically. The invention automatically returns non-empty containers and containers with unacceptable or unreadable bar codes to the user. The user is also provided warning messages when the storage bins are nearly full, or when a container is jammed in the machine.

18 Claims, 12 Drawing Sheets

(CONT. ON FIG.6B)

REVERSE VENDING MACHINE

CROSS REFERENCE TO RELATED APPLICATION(S)

Not Applicable.

FIELD OF INVENTION

This invention relates to beverage container recycling machines, and more particularly to a novel reverse vending machine.

DISCUSSION OF RELATED ART

The present invention relates generally to beverage container recycling machines, and more particularly to a reverse vending machine for beverage containers which provides a significant variety of useful functions in addition to compacting and storing beverage containers.

In recent times as various types of beverage containers have been produced in ever increasing quantities, a corresponding need has developed to recycle used beverage containers in the most cost effective and efficient manner possible. Legislation has been enacted in many states requiring that redemption deposits be imposed on beverage containers to encourage consumers to redeem their used beverage containers, thereby avoiding the environmental problems caused by discarded beverage containers. Other states have initiated programs to encourage voluntary recycling of beverage containers without imposing redemption deposits on beverage containers. Redemption of used beverage containers has thus necessitated the development of economical and effective beverage container recycling equipment.

Recycling of used beverage containers, without the use of automated equipment, usually requires extensive manual labor, personnel costs, and production space in order to properly sort, compact, and count large quantities of used beverage containers. Such methods of recycling may require unacceptably high production costs, making the recycling process economically impractical. A need has therefore developed in the recycling industry for convenient, efficient, cost effective container recycling equipment, capable of accepting a variety of beverage container types.

U.S. Pat. No. 7,754,990 to Saether illustrates a reverse vending machine capable of receiving, sorting, and storing used beverage containers. A conveyor means is used to convey and sort the container objects. U.S. Pat. No. 5,161,661 to Hammond discloses a reverse vending apparatus which diverts inserted containers to one of two compaction roller sets, which compact the beverage containers and deliver them to receptacles.

Current beverage container recycling technology has not properly addressed several requirements in the container recycling process. The present invention is a reverse vending machine providing a combination of advanced features which do not appear to be addressed by current technologies. The present invention includes the ability to detect and reject non-empty beverage containers or beverage containers with improper or unreadable bar codes. The invention also accepts beverage containers inserted from either the top or bottom of the beverage container. Other useful and/or novel features include a self cleaning system, the ability to print user coupons, and the ability to store all transaction data including the date, time, user ID, bar code data, and the user selected coupon.

Clearly there is a need for a reverse vending machine which will offer the advanced features described above, thereby improving the efficiency and cost effectiveness of the container recycling process. The present invention accomplishes these objectives.

SUMMARY

The present invention is a reverse vending machine (RVM) which accepts plastic and metallic beverage containers for processing. The reverse vending machine provides a variety of functions including compacting, sorting, and storing the beverage containers. Other functions of the reverse vending machine include issuing coupons to users, storing all transaction information, and displaying messages and other information to users.

Surveillance cameras are mounted at strategic locations on the frame of the reverse vending machine to record user interaction with the machine. If the machine is vandalized, the vandal may be identified using the recorded video output of the surveillance cameras. Using an Ethernet or other type of network connection, the videos can be viewed at remote locations. One or more video displays are mounted on the outside of the frame so that users may conveniently view machine user instructions, transaction information, public information, advertisements, etc. A self-cleaning system effects cleaning of the interior mechanical components of the reverse vending machine with the use of a cleaning solvent.

A dual level intake chute assembly is configured to accept non-metallic and metallic beverage containers. A unique feature of the invention allows the user to insert a beverage container either top first or bottom first, without requiring a specific insertion direction. Gravity is utilized to move the beverage container down the intake chute. A bar code scanner scans the bar codes of the beverage containers inserted in the dual level intake chute. If for any reason the beverage container is rejected by the machine, the intake chute is raised thereby returning the beverage container.

Several types of sensors provide data to the PLC computer in order to monitor and control the operation of the machine. A chute position detection sensor provides data as to the position of the intake chute. An ingress-egress sensor provides data to ensure that no objects are blocking the entrance of the intake chute when the intake chute needs to be raised or lowered. Should a beverage container fail to exit the intake chute, the motor activation is disabled and a warning message is displayed to the user.

A load cell sensor within the intake chute assembly is configured to produce beverage container weight data. Beverage container weight data is processed by a special software algorithm running on the PC. If a beverage container exceeds a certain threshold weight, indicating that the container is not empty, then the beverage container is returned to the user via the intake chute.

The compacter sub assembly, which compacts the beverage containers, includes a back panel, a side panel, and a container remover. A geared motor, chain sprocket, and gear sprocket provide the drive mechanism for the compacter sub assembly. An inverter controls the direction and rotation speed of the geared motor. The inverter receives commands from a PLC. The PLC will disable operation of the reverse vending machine when the front panel door is open.

Within the compacter sub assembly, rotating impeller shafts are configured with protruding impeller arms. The impeller arms push the beverage containers down and into the rotating spur gears thereby compacting the beverage containers. The container remover utilizes protruding nails to prevent any beverage containers from becoming stuck to the impeller arms.

In one embodiment of the invention, separate storage bins for metallic beverage containers and non-metallic beverage containers are included in the frame of the invention. The invention stores compacted bottles in the bottle storage bin, and compacted cans are stored in the can storage bin. A full bin sensor detects when the storage bins have filled up with compacted beverage containers, and provides the data to a PC. When the storage bins have filled up, an empty bin message is displayed on the video monitor.

The compacted beverage containers are delivered into the sorter sub assembly, which includes a back panel and a side panel. A sorting flap rotates on a shaft mounted on bearings, and is driven by a geared motor mounted on a motor bracket. The sorting flap is configured to divert each beverage container to either the bottle storage bin or else the can storage bin.

A controller box contains the control system components of the invention, including a PLC (programmable logic controller) to control the reverse vending machine. The PLC controls the motion of various components of the machine.

An IBM compatible PC (personal computer) is configured for processing, storing and retrieving data from the various sensors on the machine. The proprietary software program also controls the motion of the reverse vending machine and displays messages to the users on the video displays. For example, data produced by the container weight sensor is processed by the PC. If a non-empty beverage container is inserted in the intake chute, the beverage container is returned to the user, and an appropriate message is displayed on the video screen.

Other status conditions may be processed by the PC software algorithms, including data received from the bar code scanner and from various sensors on the reverse vending machine, such as the ingress-egress sensor, the full bin sensor, and the like. If the bar code scanner is unable to scan a beverage container, or else if the beverage container bar code is unregistered, or else if the beverage container is non-recyclable, the algorithm running on the PC will cause the beverage container to be returned to the user.

The reverse vending machine includes a coupon printer whereby coupons may be printed for users after they have recycled beverage containers. A coupon selection switch allows the user to select up to twelve different coupons, or else receive credit instead of a coupon. Coupon instructions will appear on the display screen after the user has processed their beverage containers. The reverse vending machine can limit the number of coupons issued when necessary. A sensor within the coupon printer detects when the diameter of the coupon printer paper roll reaches a minimum threshold. A low paper condition signal is then sent to the PC, which displays a message on the display screen, and also sends a message via wired or wireless a network connection.

Users may accumulate credit for beverage containers by means of an ID reader configured to produce user data to be processed by the PC algorithms. The ID reader may utilize a magnetic strip, a smart IC, and/or RFID technology to produce user ID data.

A number of switches in the control box allow manual operation of the reverse vending machine components. An auto/manual operation switch, may be set to "auto" to allow normal operation of the reverse vending machine. The auto/manual switch may be set to "manual" to cause the geared motor in the compacter sub assembly to operate continuously. The compacter forward/reverse switch will then control the direction of the geared motor. A sorter CAN/PET switch allows the user to change the position of the sorting flap from CAN containers to PET containers, or vice versa.

Other features and advantages of the present invention will become apparent from the following more detailed description, taken in conjunction with the accompanying drawings, which illustrate, by way of example, the principles of the invention.

DESCRIPTION OF THE DRAWING(S)

DETAILED DESCRIPTION OF THE PREFERRED EMBODIMENT

Figure 1:
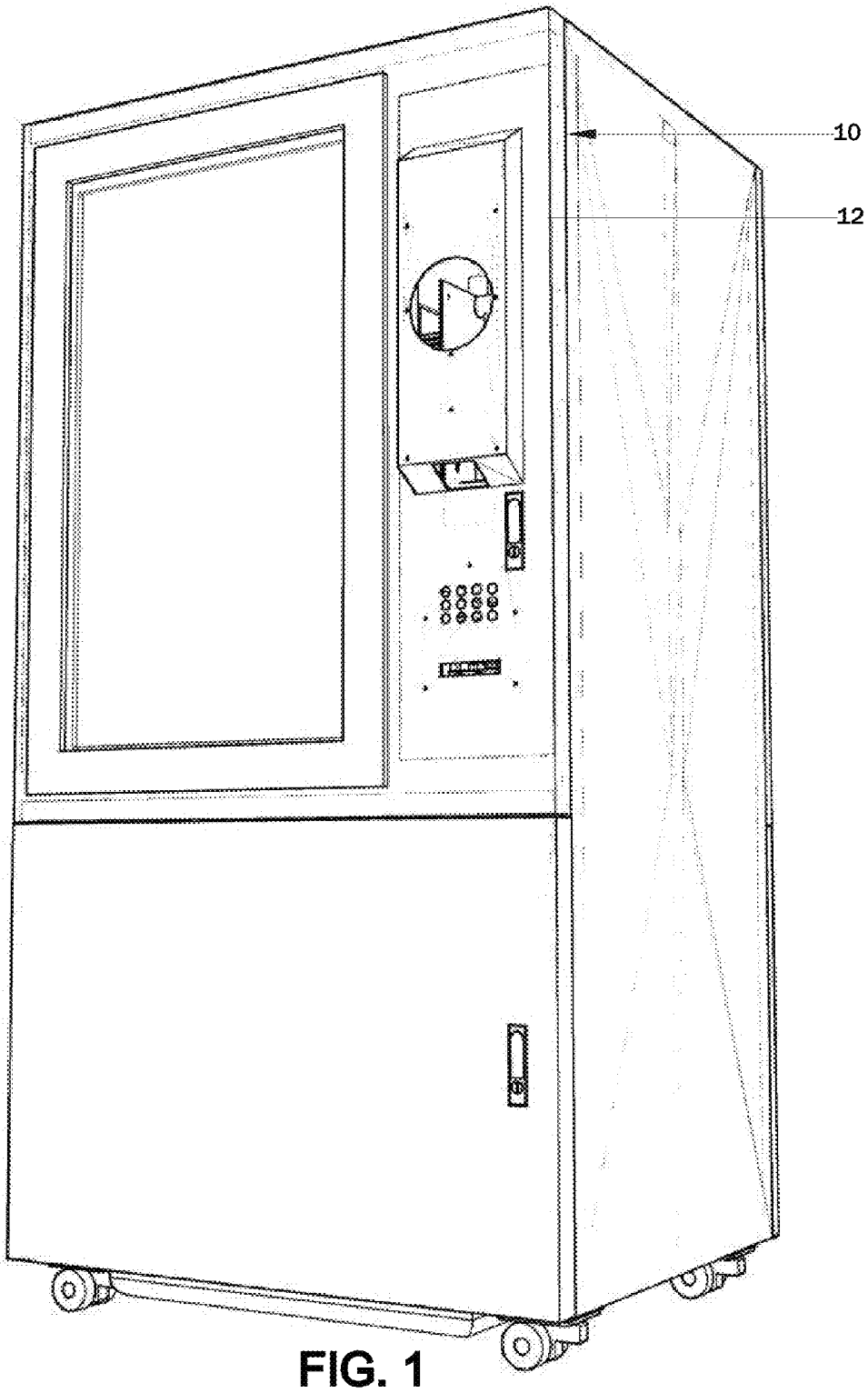
FIG. 1 is a perspective view of the present invention.

The present invention, a reverse vending machine 10, is shown in FIG. 1. The reverse vending machine 10 accepts non-metallic and metallic beverage containers for processing, which includes compacting, sorting, and storing the beverage containers. Other functions of the reverse vending machine 10 include issuing coupons to users, storing all transaction information including the date, time, user ID, beverage container bar code, coupon data, and ingress/egress status.

Figure 2:
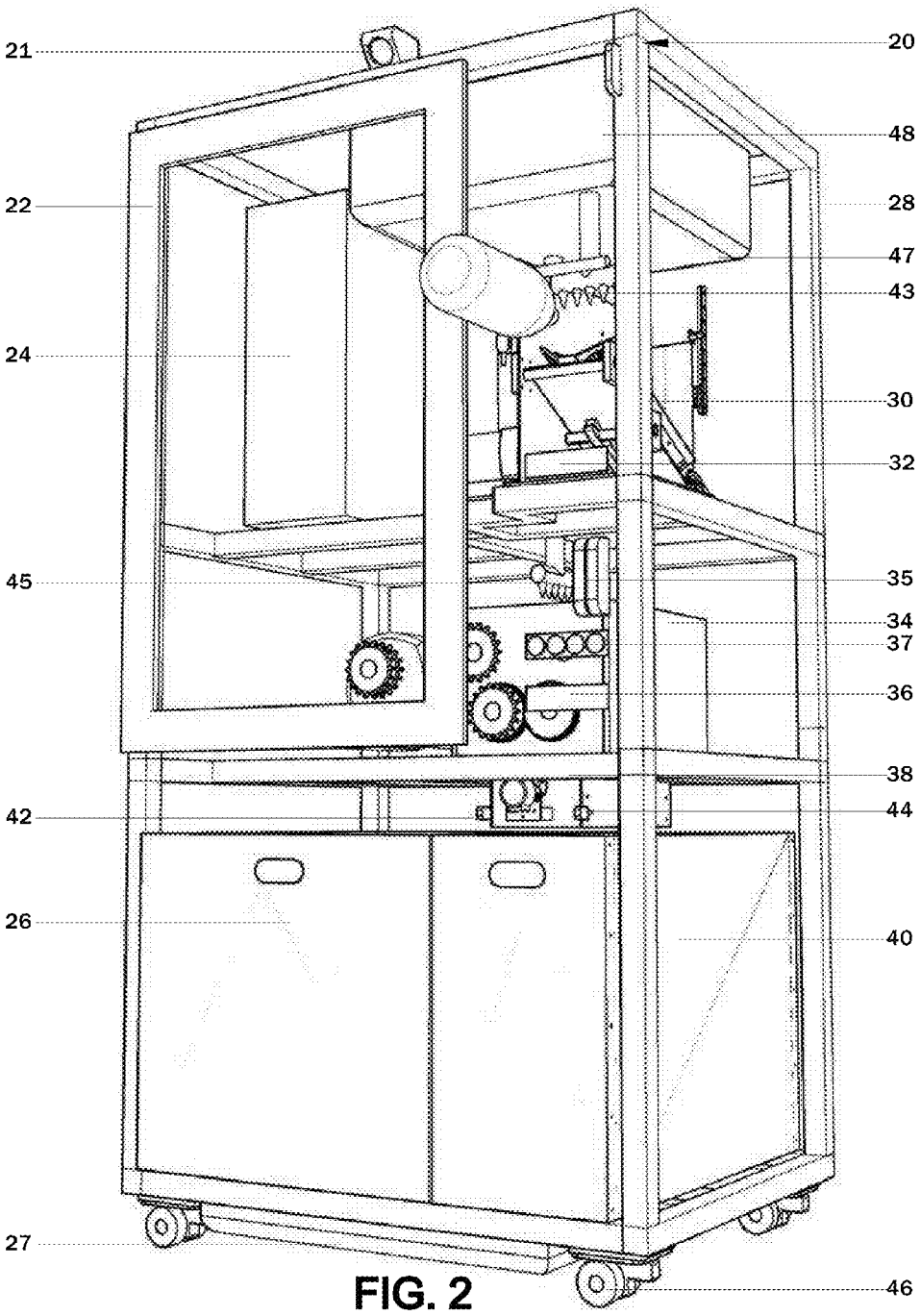
FIG. 2 is a perspective view of the frame of the present invention.

Turning to FIG. 2, the frame 20 of the reverse vending machine 10 is shown. A front panel door 12 allows access to the interior of the reverse vending machine 10. A plurality of surveillance cameras 21 are mounted at strategic locations on the frame 28 of the reverse vending machine 10 to record user interaction with the machine. If the reverse vending machine 10 is vandalized, the vandal may be identified using the recorded video output of the surveillance cameras 21. Using a wired or wireless Ethernet network connection 222 on the reverse vending machine 10, the videos can be viewed at remote locations.

One or more video displays 22 are mounted on the outside of the frame 28 so that users may conveniently view reverse vending machine 10 user instructions, transaction information, public information, advertisements, etc.

The self-cleaning solvent tank 47, a component of the self-cleaning system, is shown near the top of FIG. 2. Solvent is poured or pumped into the solvent tank, where it then traverses the interior of the reverse vending machine 10 via a plurality of fluid connections. Cleaning solvent exits through a plurality of nozzles 43,45 to effect cleaning of the interior mechanical components of the machine. Used cleaning solvent is then collected in a cleaning solution drainage pan 27 near the bottom of the machine.

The intake chute assembly 30 in FIG. 2 is a beverage container chute configured to accept non-metallic and metallic beverage containers. A detailed view of the dual level chute assembly 50 is shown in FIG. 3, including the side panel 52, the bottom panel 76, the sliding door 66, the motor platform 58, and the spacer 54.

Figure 3:
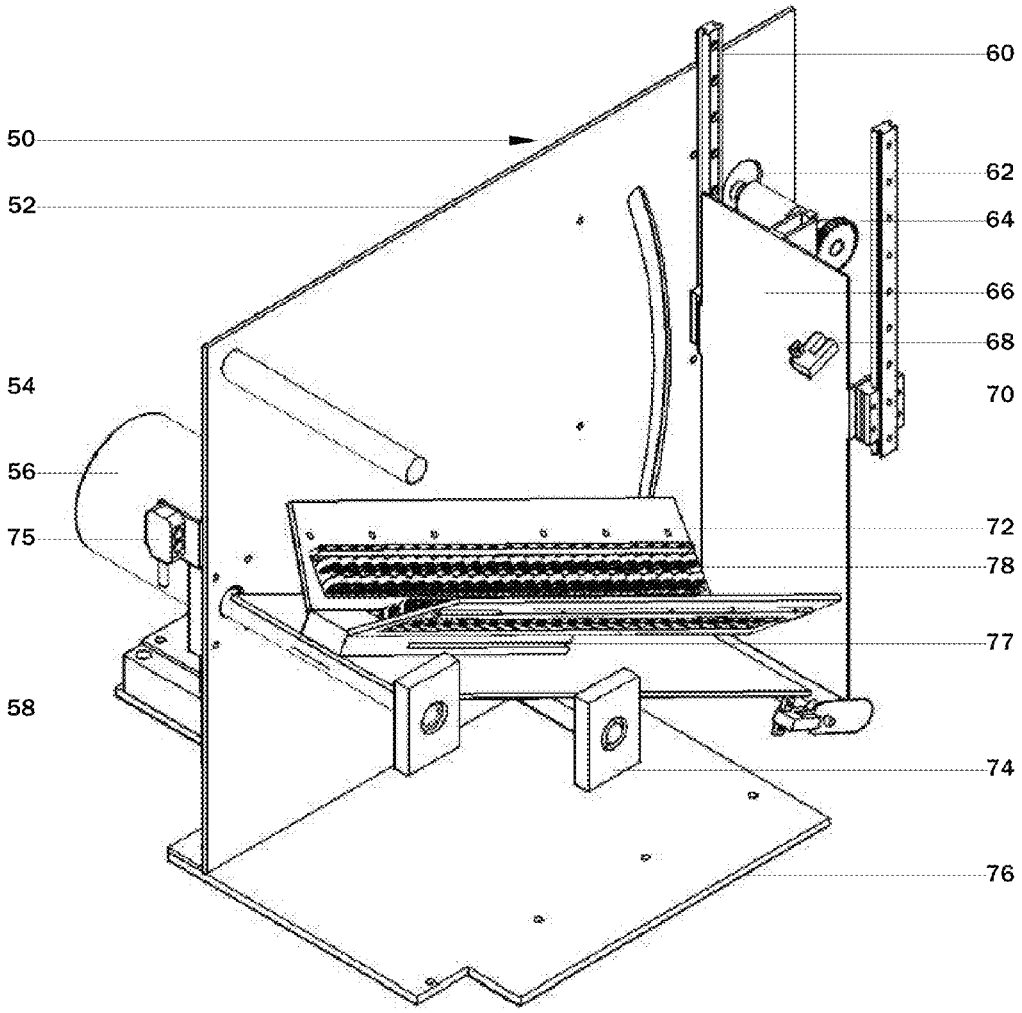
FIG. 3 is a perspective view of the intake chute assembly of the present invention.

Turning to FIG. 3, beverage containers are inserted by the reverse vending machine 10 user into the intake chute 72. A unique feature of the invention allows the user to insert a beverage container either top first or bottom first, without requiring a specific insertion direction. Gravity is utilized to move the beverage container down the intake chute 72 on top of the feed rollers 78. The sliding door 66 holds the container until the reverse vending machine 10 accepts or rejects it. The chute position sensor 68 informs the reverse vending machine 10 of the position of the intake chute 72. The intake chute 72 moves to its upper level when the reverse vending machine 10 is returning an inserted beverage container. When the intake chute 72 moves to its lower level, the reverse vending machine 10 is either measuring the beverage container weight or else waiting for a beverage container to be inserted in the intake chute 72.

A bar code scanner 32 (FIG. 2) scans the bar codes of the beverage containers inserted in the dual level intake chute 72. If for any reason the beverage container is rejected by the machine, the intake chute 72 is raised thereby returning the beverage container. The intake chute 72 is mounted on bearings 74, and is raised to its upper level through the action of a carriage 70 ascending a pair of rails 60, where the carriage 70 is powered by a motor 56, a motor shaft 62, and a gear 64.

Several types of sensors provide data to the PC 210 (personal computer shown in FIG. 9) in order to monitor and control the operation of the reverse vending machine 10. A chute position detection sensor 68 provides data as to the position of the intake chute 72. An ingress-egress sensor 75 provides data to insure that no objects are blocking the entrance of the intake chute 72 when the intake chute 72 needs to be raised or lowered. Should a beverage container fail to exit the intake chute 72, the motor activation is disabled and a warning message is displayed to the user.

Figure 9:
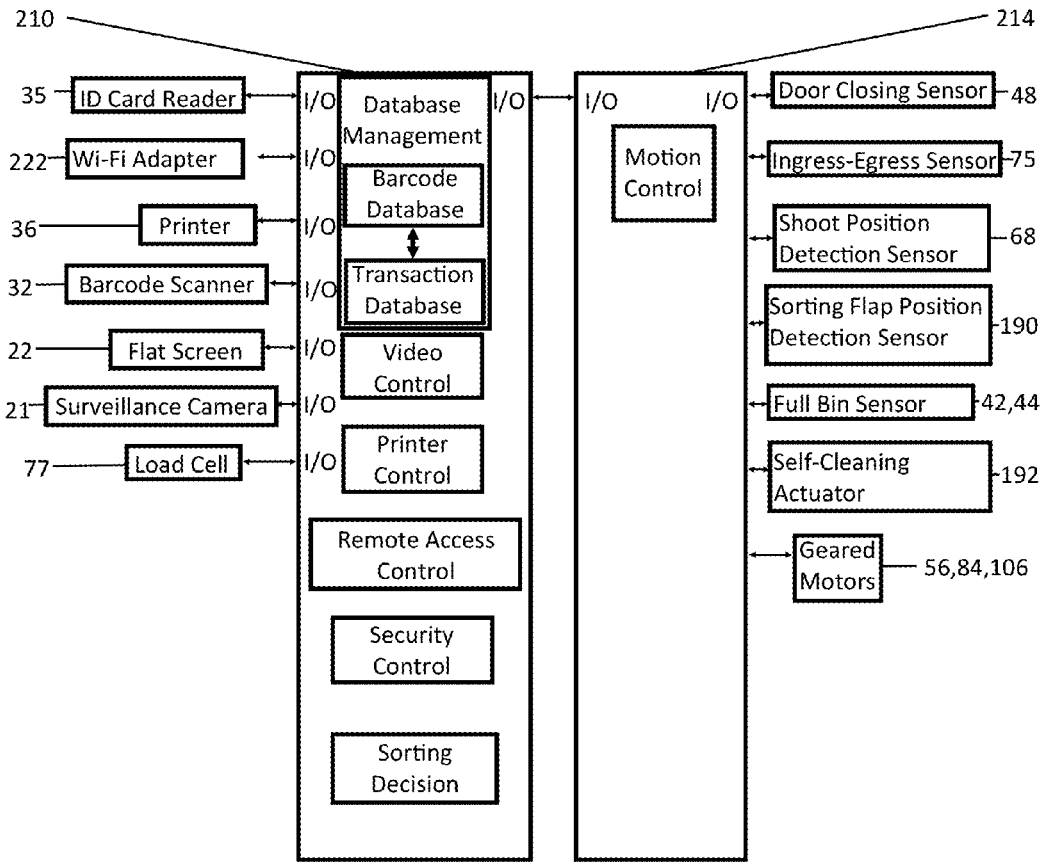
FIG. 9 is a functional block diagram of the present invention.

In FIG. 3 is shown the load cell weight sensor 77, which is a type of sensor configured to produce beverage container weight data. Beverage container weight data is processed by a special software algorithm running on a PC 210 (FIG. 9). If a beverage container exceeds a certain threshold weight, indicating that the container is not empty, then the beverage container is returned to the user. If the threshold weight is not exceeded, then the reverse vending machine 10 can proceed to compact the beverage container. Non-empty beverage containers are returned by raising the intake chute 72 thereby returning the containers to the user.

Figure 4:
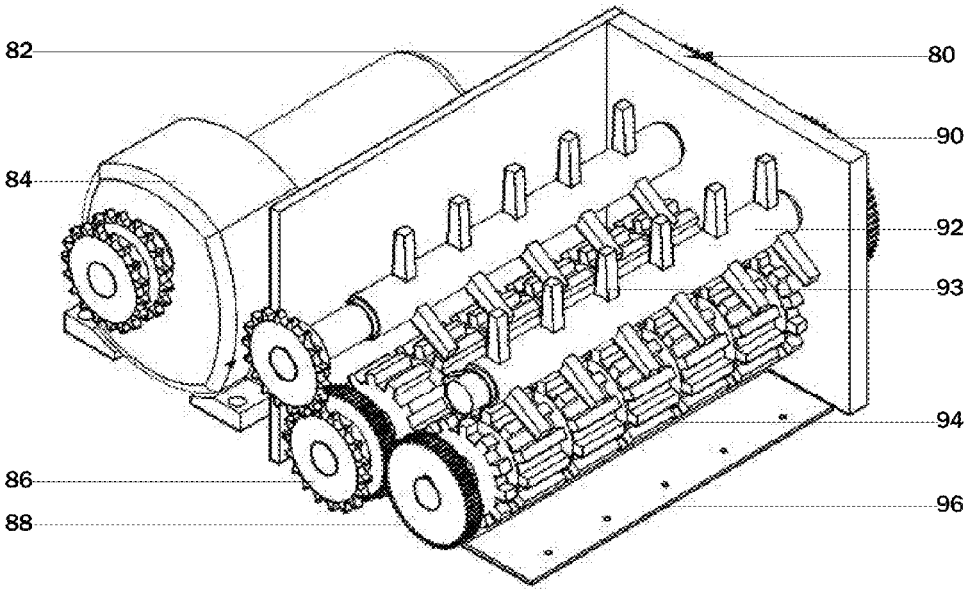
FIG. 4 is a perspective view of the compacter assembly of the present invention.

The compacter assembly 34, which compacts the beverage containers, is shown in FIG. 2. Turning to FIG. 4, a detailed view of the compacter assembly 80 is shown. The compacter assembly 80 includes a back panel 90, a side panel 82, and a container remover 96. A geared motor 84, chain sprocket 86, and gear sprocket 88 provide the drive mechanism for the compacter sub assembly. An inverter 220 (FIG. 10) controls the direction and rotation speed of the geared motor 84. The inverter 220 receives commands from the PLC 214, described below. A door closing sensor 48 includes a reed switch connected to the PLC 214, so that the PLC 214 will disable operation of the reverse vending machine 10 when the front panel door 12 is open.

Within the compacter sub assembly 80, a plurality of rotating impeller shafts 92 are configured with a plurality of protruding impeller arms 93. The impeller arms 93 push the beverage containers down and into the rotating spur gears 94 thereby compacting the beverage containers. The container remover 96 utilizes protruding nails to prevent any beverage containers from becoming stuck to the impeller arms 93.

In one embodiment of the invention, separate storage bins 26,40 for metallic beverage containers and non-metallic beverage containers are included in the frame of the invention. As shown in FIG. 2, the invention stores compacted bottles in the bottle storage bin 26, and compacted cans are stored in the can storage bin 40. A plurality of full bin sensors 42,44 detect when the storage bins 26,40 have filled up with compacted beverage containers, and provide the data to a PC 210, described below. When the storage bins 26,40 have filled up, an empty bin message is displayed on the video monitor 22.

Figure 5A:
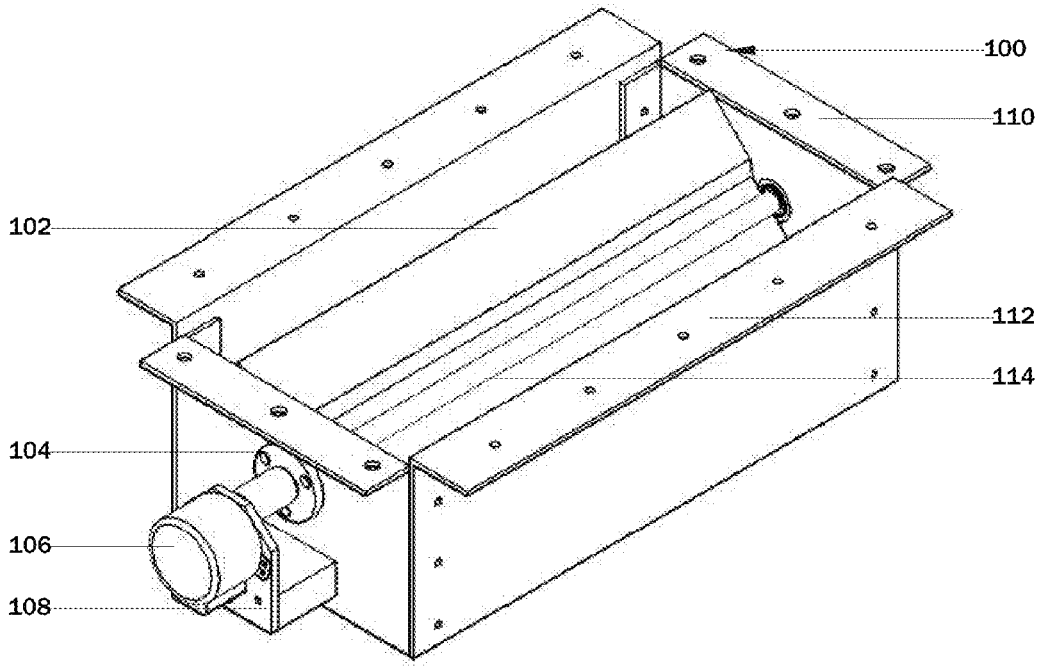
FIG. 5A is a front perspective view of the sorting assembly of the present invention.
Figure 5B:
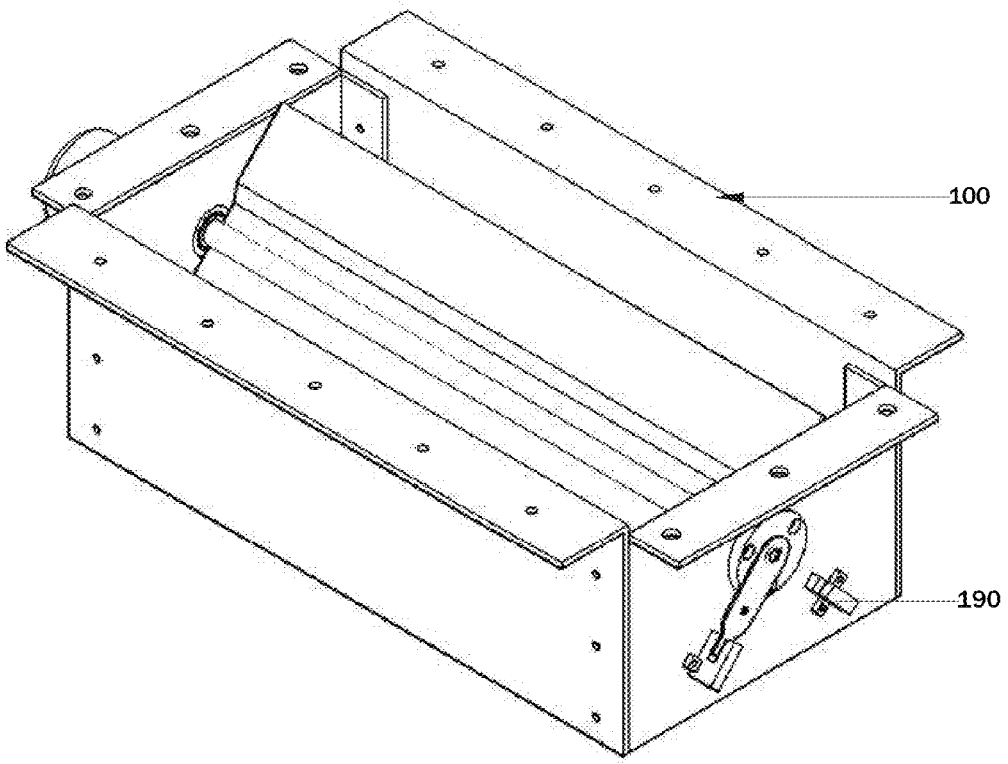
FIG. 5B is a rear perspective view of the sorting assembly of the present invention.

The compacted beverage containers are delivered into the sorter sub assembly 38, shown in FIG. 2. Turning to FIG. 5A & FIG. 5B, a detailed view of the sorter assembly 100 is shown. The sorter assembly 100 includes a back panel 110 and a side panel 112. A sorting flap 102 rotates on a shaft 114 mounted on bearings 104, and is driven by a geared motor 106 mounted on a motor bracket 108. The sorting flap 102 is configured to divert each beverage container to either the bottle storage bin 26, shown in FIG. 2, or else the can storage bin 40. The sorting flap position sensor 190 is shown in FIG. 5B.

Figure 10:
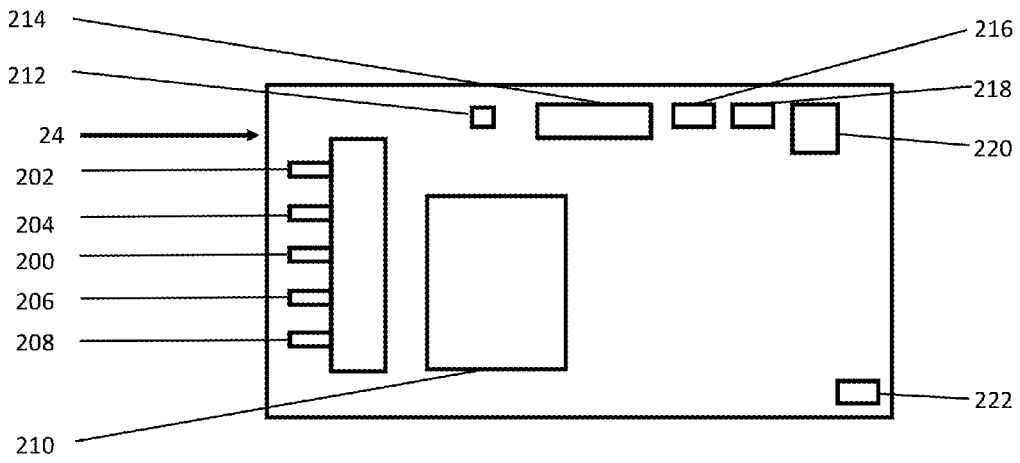
FIG. 10 is a diagram of the controller box layout of the present invention.

As shown in FIG. 2, a controller box 24 contains the control and electronic system components of the invention, including a PLC (programmable logic controller) 214 to control the reverse vending machine 10. A detailed layout of the controller box 24 is shown in FIG. 10. The PLC 214 controls the motion of various components of the reverse vending machine 10. The PLC operation is detailed in the flow charts in FIG. 6A to FIG. 7. An A/D converter 216 converts analog output signals from the load cell 77 to a digital signal, which is then sent to the PLC 214. The PLC 214 can then determine the relative weight of a beverage container acting on the load cell 77. Included in the controller box 24 is a main power switch 200, strain gauge amplifier 212, A/D converter 216, 24 VDC power supply 218, inverter 220, and network adapter 222.

An IBM compatible PC (personal computer) 210, including a storage system configured for storing and retrieving data, and a computer operating system running a proprietary software program, are responsible for processing and storing data from the various sensors on the machine.

Figure 6A:
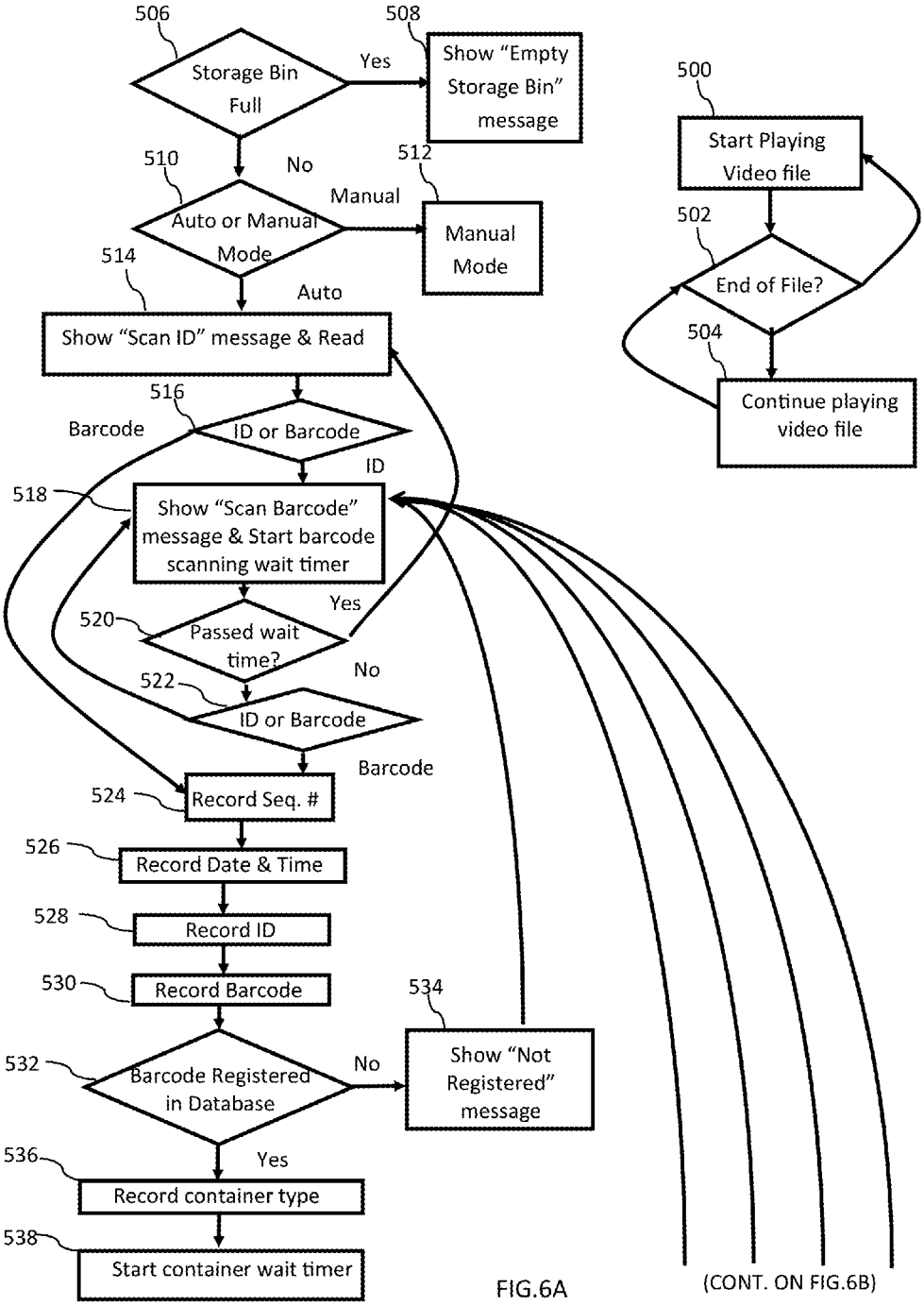
FIG. 6A is a flowchart of the PC software of the present invention in auto or manual mode.

FIG. 6A shows a flowchart of the PC 210 software program of the invention 10. The PC 210 is not used while the reverse vending machine 10 is in manual mode. The proprietary software program also controls the motion of the reverse vending machine 10 and displays messages to the users on the video display 22. For example, data produced by the container weight sensor 77 is processed by the PC 210. If a non-empty beverage container is inserted in the intake chute 72, the beverage container is returned to the user, and an appropriate message is displayed on the video screen.

Turning to FIG. 6A, at step 500, the program starts to play the video file that has been programmed in. At the end of the video file, step 502 is reached. The program will restart the file at step 504 and continue playing it until it reaches the end (step 502). The program will sense if storage bins 26,40 is/are full at step 506. If the storage bin 26,40 is full, the program continues to step 508 and shows the "Empty Storage Bin" message on the flat screen 22. If the storage bin 26,40 is not full, the program continues to step 510 and checks to see which mode is enabled. If Manual Mode is enabled, the program goes to step 512 and the program pauses. If Automatic Mode is enabled, the program moves to step 514. In step 514 the program displays the "Scan ID" message on the screen and asks the user to scan their ID or a bar code. In step 516 the program determines if the ID or bar code has been scanned and moves to the next appropriate step. If the customer scans an ID card, the program then moves on to step 518 and starts a countdown timer to have the customer scan a bar code at this point. If the customer waits too long to scan (step 520) the program goes back to step 514 and starts the process over again. If the customer scans a bar code in a timely manner the program continues on to step 522 and then continues to step 524. If the customer scans a bar code during step 516, the program skips to step 524 and records the sequence number. Step 526 then causes the date and time to be recorded and mapped to the sequence number on step 524. In step 528 the program then creates a unique record number tied to the sequence number and the date/time in the previous steps. Step 530 then records the bar code of the item. The bar code recorded in step 530 is then matched to the invention 10 database in step 532 to determine if it's registered in the system. If the bar code is not registered, the program moves to step 534 and the "Not Registered" message appears on the flat screen 22, the container is rejected by the invention 10, and the transaction ends causing the program to go back to step 518. If the bar code is registered in the system, step 536 causes that bar code number to be recorded and matched to the record, sequence, date & time. Based on the bar code the program also records the type of container (plastic or aluminum) that is being inserted. Once the bar code has been validated, the program moves to step 538 and waits for the customer to insert the container into invention 10.

Figure 6B:
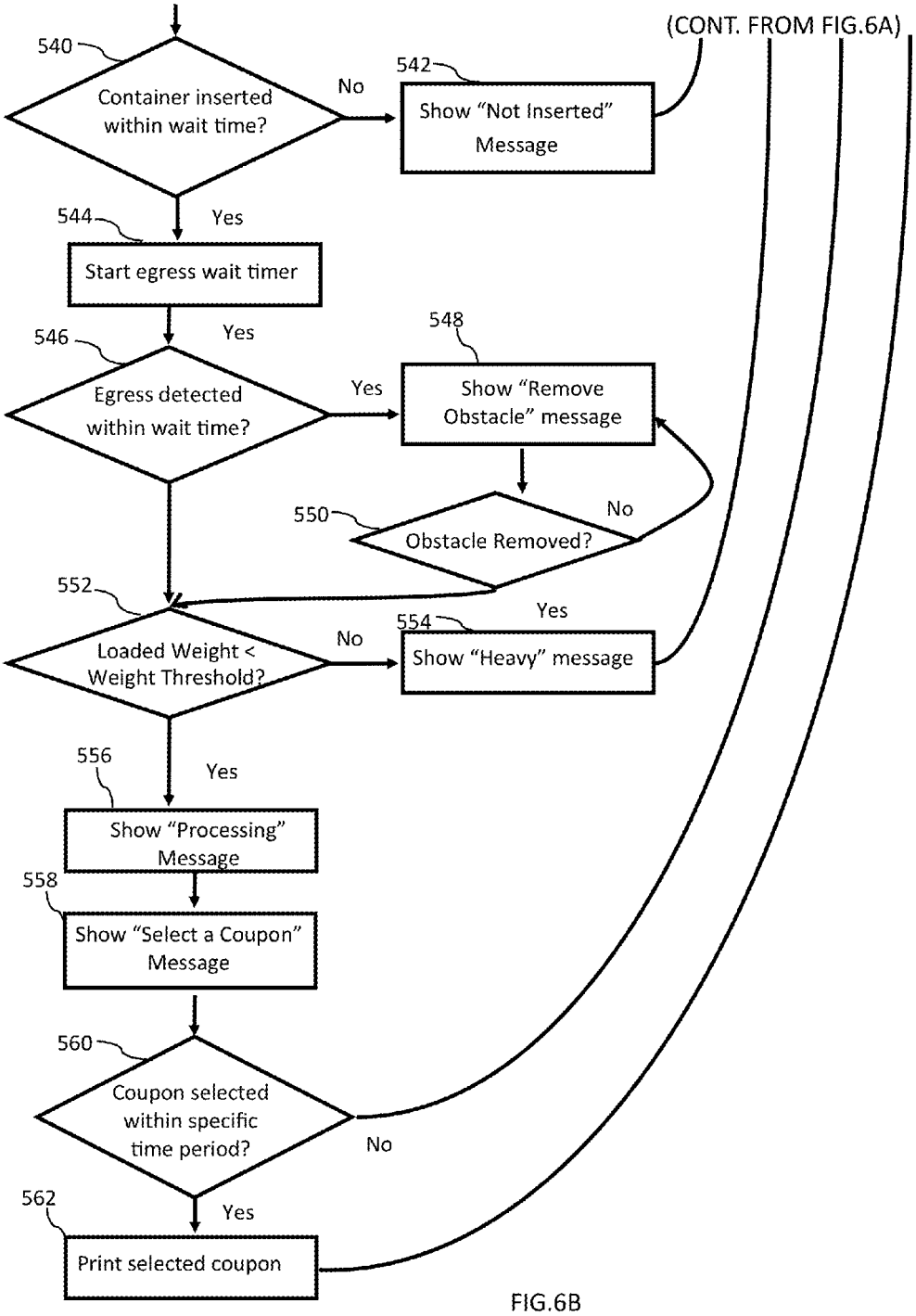
FIG. 6B is a flowchart of the PC software of the present invention in auto or manual mode.

In FIG. 6B, if the customer inserts the container in the time frame within step 540, the program continues on. If the customer does not insert the container in a timely manner as per step 540, the program moves to step 542 and the "Not Inserted" message is displayed on the flat screen 22. At this point the program will default back to step 518 and the transaction begins again. Once the container is in the machine, the egress wait timer in step 544 begins. If the container is placed correctly and timely into invention 10 the program continues on to step 546 and moves on. If the container is not placed into invention 10 correctly or if it detects an issue with the item placed inside, the program moves on to step 548 and flashes the "Remove Obstacle" message on the flat screen 22. If the obstacle is removed, as per step 550, the program continues onto the next step. The weight of the container is determined and if it is less than the threshold as indicated by step 552, the container is accepted and the program continues. Step 544 occurs if the weight is greater than the threshold. The flat screen 22 will then display the "Heavy" message and it will reset the process once the object has been removed and begin at step 518 again. Accepted containers are then collected within invention 10 and the flat screen 22 will show a "Processing" message to let the customer know as per step 556. Once a container has been processed, step 558 asks the customer to choose a coupon from the ones listed on the flat screen 22. If the coupon is selected within the time frame (step 560) the program then tells the invention 10 to print the selected coupon (step 562) for the customer. If the customer does not choose a coupon in the specified time period (step 560) the program will end the transaction and begin again at step 518 with the next customer/container.

Figure 7:
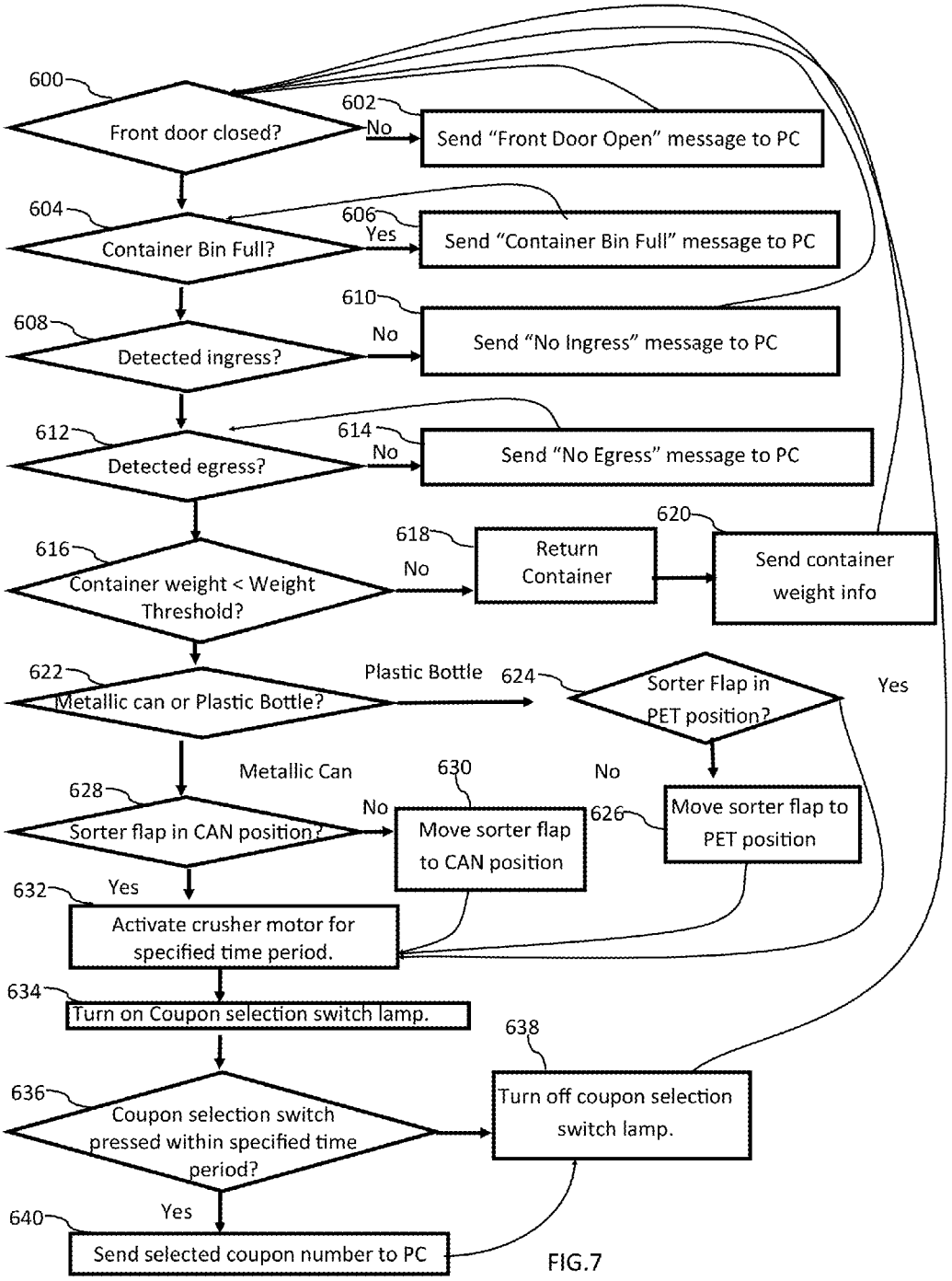
FIG. 7 is a flowchart of the PLC software of the present invention in auto mode.
Figure 8:
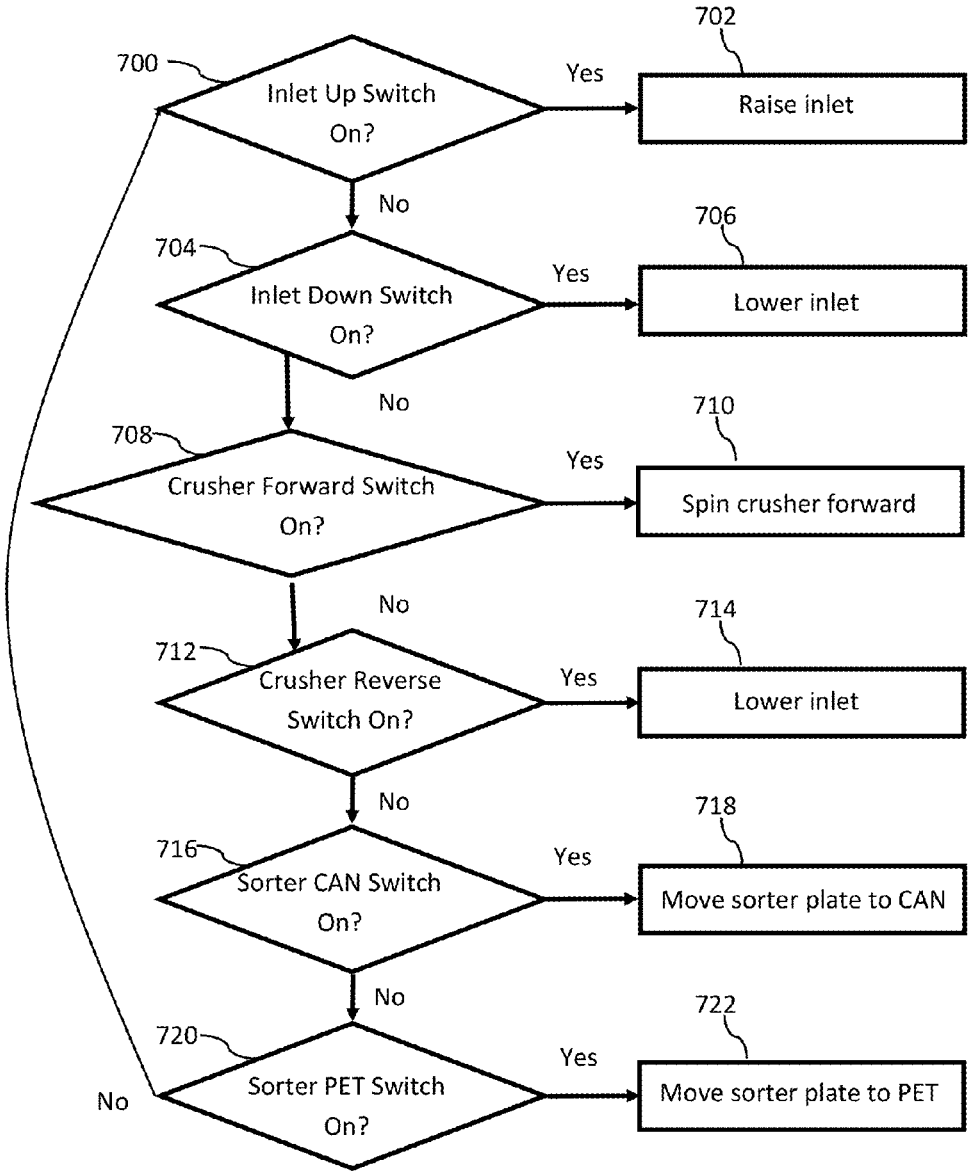
FIG. 8 is flowchart of the PLC software of the present invention in manual mode.

FIGS. 7 & 8 illustrate the PLC software flow. In FIG. 7, step 600 checks to make sure the front door panel 12 of invention 10 is closed. If the front door panel 12 is not closed, step 602 causes the PC 210 to receive a "Front Door" open message and not operate until the front door panel 12 is closed. Step 604 determines if one of the storage bins 26,40 bins is/are full or can still accept materials. If the sensor determines that one of the storage bins 26,40 is/are full, step 606 lets the PC 210 know and an "Empty Container" message will be displayed on the flat screen 22. Step 608 will detect an ingress within the invention 10. If it does not detect the ingress, step 610 will send a message to the PC 210 letting it know that there is no ingress. If this does not get resolved, the program will revert back to step 600 to make sure the front door panel 12 is closed. Step 612 will let invention 10 know if it is ready to accept materials because the egress is ready for a container to be added. If there is a blockage, the program moves to step 614 and sends a "No Egress" message to the PC 210 and it will not operate until this has been cleared. Step 616 utilizes the weight sensor to make sure the container is less than the threshold weight which has been programmed into the unit for plastic or aluminum containers. If the weight exceeds the threshold, the program will return the container as per step 618. Step 620 will cause the invention 10 to collect the weight information for heavy containers. Step 622 uses the weight information provided to determine if the container is plastic or aluminum. If the item is a plastic container, step 624 will determine if the sorter flap 102 is in position to have the container sent to the PET bottle storage bin 26 area within the invention 10. If the sorter flap 102 is not in position, step 626 will move the sorter flap 102 to the PET position. If the Item is a can, the computer will check to see if the sorter flap 102 is in the position to place the can into that can storage bin 40 within the invention 10. If the sorter flap 102 is not in position for the can storage bin 40, step 630 causes the sorter flap 102 to move into position. Step 632 will cause the crusher sub-assembly 80 to activate once the sorter flap 102 has moved to the correct position and delivered the container to the crusher sub-assembly 80. Once the crusher sub-assembly 80 has run its course and processed the container, the program will turn on the coupon selector switch 37 (step 636) for a specified amount of time. If the customer selects a coupon in the time period, step 640 sends the information for the selected coupon to the PC 210 so it gets printed. The coupon selector switch 37 will then turn off (step 638). If the coupon is not selected in the specified amount of time, step 638 will disable the coupon selection for that transaction.

In FIG. 8, step 700 detects if the inlet is ready to place the container into the crusher sub assembly 80 and then into the appropriate storage bin 26,40 within invention 10. If the switch is on, then the program will raise the inlet (step 702) so that the container can move into the crusher and then to the bin.

If step 700 does not detect the inlet, step 704 will cause the inlet to lower (step 706) so that it is now in position to move the container through the crusher sub-assembly 80 into the appropriate container storage container 26,40. Once the inlet has moved the container into position, step 708 determines if the crusher sub assembly 80 is ready to process the container. If the crusher sub assembly 80 is not in the forward position, step 710 will cause it to spin forward and crush the container. If the crusher sub assembly 80 is already forward, step 712 will cause the crusher sub assembly 80 to spin back allowing room for the container to be inserted so that it can be processed. Once the container has been crushed, step 714 will move the inlet plate to allow the container to be placed into the correct storage bin 26,40. If the container was determined to be aluminum step 716 will be 'on' and it will cause step 718 to activate moving the plate in position to deposit the container into the aluminum storage bin 40. If the container was determined to be plastic, step 720 will be 'on' and it will cause step 722 to activate moving the plate in position to deposit the container into the PET storage bin 26. Once the container has been deposited this process will reset and begin again at step 700.

Other status conditions may be processed by the PC 210 software algorithms, when data has been received from the bar code scanner 32 and from various sensors on the reverse vending machine 10, including the ingress-egress sensor 75, the full bin sensors 42 & 44, and the like. For example, if the bar code scanner 32 is unable to scan a beverage container, or else if the beverage container bar code is unregistered, or else if the beverage container is non-recyclable, the software algorithm running on the PC 210 will cause the beverage container to be returned to the user.

The reverse vending machine 10 includes a coupon printer 36 whereby coupons may be printed for users after they have recycled beverage containers. A coupon selection switch 37 allows the user to select up to twelve different coupons, or else receive credit instead of a coupon. Coupon instructions will appear on the display screen after the user has processed their beverage containers. The reverse vending machine 10 can limit the number of coupons issued when necessary. A sensor within the coupon printer 36 detects when the diameter of the coupon printer 36 paper roll reaches a minimum threshold. A low paper condition signal is then sent to the PC 210, which displays a message on the display screen 22, and also sends a message via a network connection 222.

Users may accumulate credit for beverage containers by means of an ID reader 35 configured to produce user data to be processed by the PC 210 algorithms. The ID reader 35 may utilize a magnetic strip, a smart IC, and/or RFID technology to produce user ID data.

A number of switches in the control box 24 allow manual operation of the reverse vending machine 10 components. An auto/manual operation switch 202, is set to "auto" to allow normal operation of the reverse vending machine 10. The auto/manual switch 202 may be set to "manual" to cause the geared motor 84 in the compacter sub assembly 80 to operate continuously. The compacter forward/reverse switch 206 will then control the direction of the geared motor 84. A sorter CAN/PET switch 208 allows the user to change the position of the sorting flap 102 (FIG. 5A) from CAN to PET, or vice versa.

That which is claimed is:

1. A reverse vending machine comprising:
- a frame;
- a dual level intake chute configured to accept beverage containers;
- a sliding door configured to hold beverage containers within said intake chute;
- a plurality of rotating impeller shafts;
- a plurality of impeller arms extending radially outward from said impeller shafts;
- a plurality of compacting shafts proximate to said impeller shafts;
- a plurality of compacting spur gears rotating on said compacting shafts;
- a plurality of beverage container storage compartments;
- a rotatably mounted sorter flap configured to convey metallic and non-metallic beverage containers to separate storage compartments;
- a self-cleaning system configured to clean the mechanical components of the reverse vending machine;
- a control system; and
- a messaging system.

2. The reverse vending machine of claim 1, further including a beverage container rejection mechanism configured to reject beverage containers with unacceptable characteristics.

3. The reverse vending machine of claim 1, wherein said beverage container storage bin system includes separate storage bins for metallic beverage containers and non-metallic beverage containers.

4. The reverse vending machine of claim 1, further including a container weight sensor configured within the channel of said dual level intake chute.

5. The reverse vending machine of claim 1, wherein said messaging system comprises one or more video displays whereby instructions, information, and advertisements may be displayed.

6. The reverse vending machine of claim 1, wherein the self-cleaning system comprises:
- a cleaning solution tank including a fluid intake path;
- a cleaning solution drainage pan;
- a plurality of fluid connections between the cleaning solution tank and the cleaning solution drainage pan;
- a plurality of nozzles coupled to the fluid connections.

7. The reverse vending machine of claim 1, further comprising:
- a plurality of surveillance cameras mounted at strategic locations on the exterior of the reverse vending machine;
- a wired or wireless network connection;
- means for recording video data produced by the surveillance cameras;
- means for displaying the recorded video data via the network connection.

8. The reverse vending machine of claim 1, wherein said control system further includes a PLC (programmable logic controller) and associated logic circuits to control the reverse vending machine.

9. The reverse vending machine of claim 8, further including:
- a microprocessor based computer system;
- associated arithmetic circuits;
- a storage system configured for storing and retrieving data;
- a computer operating system;
- software means for recording and analyzing data.

10. The reverse vending machine of claim 9, further including:
- a blocked intake chute sensor configured to produce blocked intake chute data; and
- computing means for processing the blocked intake chute sensor data and for
- producing appropriate display messages when blocked intake chute conditions exist.

11. The reverse vending machine of claim 9, further including:
- a plurality of storage bin sensors configured to produce storage bin status data;
- computing means for processing the storage bin status data and for producing appropriate display messages when full storage bin conditions exist.

12. The reverse vending machine of claim 9, further including computer executable instructions operative on the microprocessor for:
- processing beverage container weight data;
- producing appropriate display messages when non-empty beverage containers are present and controlling the rejection of non-empty beverage containers;
- processing beverage container bar codes;
- recording beverage container transaction information including processing time, user ID, bar code data, and coupons selected;

controlling the rejection of beverage containers which have non-recyclable, unacceptable, or unrecognizable bar codes;

processing blocked intake chute sensor data and producing appropriate display messages when blocked intake chute conditions exist;

processing the storage bin status data and producing appropriate display messages when storage bin full conditions exist;

controlling the coupon printer and issuing the correct coupons;

activating the impeller arms and the compacting gears;

diverting beverage containers to the correct storage bin;

processing the paper quantity sensor data and for displaying appropriate messages when the paper quantity falls below a predetermined threshold.

13. A reverse vending machine comprising:

a frame;

a dual level intake chute configured to accept beverage containers;

a beverage container rejection mechanism;

a plurality of beverage container storage bins, including separate storage bins for metallic beverage containers and non-metallic beverage containers;

a plurality of rotating impeller shafts configured with a plurality of protruding impeller arms;

a plurality of compacting shafts with compacting gears proximate to the impeller shafts;

a beverage container sorting system including a rotatable flap;

a PLC (programmable logic controller) and associated logic circuits to control the various components of the beverage container compacting apparatus;

a microprocessor based computer system including associated arithmetic circuits, a storage system configured for storing and retrieving data, a computer operating system, and a means for recording and analyzing data;

a plurality of video displays;

a sensor configured to produce beverage container weight data;

computing means for processing beverage container weight data;

computing means for producing appropriate display messages when non-empty beverage containers are present;

computing means for controlling the rejection of non-empty beverage containers;

a bar code scanner configured to read beverage container bar codes;

computing means for processing beverage container bar codes;

computing means for storing all beverage container transaction information including processing time, user ID, bar code data, and coupons selected;

computing means for producing transaction display messages;

computing means for controlling the rejection of beverage containers with non-recyclable, unacceptable, or unrecognizable bar codes;

a blocked intake chute sensor configured to produce blocked intake chute data;

computing means for processing the blocked intake chute sensor data and for producing appropriate display messages when blocked intake chute conditions exist;

a plurality of storage bin sensors configured to produce storage bin status data;

computing means for processing the storage bin status data and for producing appropriate display messages when full storage bin conditions exist;

a coupon printer configured to issue coupons to users;

a sensor to produce paper quantity data;

computing means for controlling the coupon printer and issue the correct coupons;

computing means for processing the paper quantity data and for producing appropriate display messages when the paper quantity falls below a predetermined threshold;

a cleaning solution tank including a fluid intake path;

a cleaning solution drainage pan;

a plurality of fluid couplings between the cleaning solution tank and the drainage pan;

a wired or wireless network connection;

a plurality of surveillance cameras;

means for recording surveillance camera.

14. A method for recycling beverage containers, the method comprising the following steps:

receiving beverage containers within an intake chute;

constraining beverage containers with a sliding door proximate to said intake chute;

receiving beverage container bar code data with a bar code scanner;

processing beverage container transaction data;

measuring beverage container weight using a weight sensor configured within the channel of said intake chute;

rejecting unacceptable or unrecognizable beverage containers;

impelling beverage containers into compacting spur gears using rotating impeller arms extending radially outward from an impeller shaft;

compacting beverage containers using said compacting spur gears;

sorting compacted metallic and non-metallic beverage containers into separate bins;

displaying messages to users; and printing coupons for users.

15. A reverse vending machine comprising:

a frame;

a dual level intake chute configured to accept beverage containers;

a plurality of rotating impeller shafts configured with a plurality of protruding impeller arms;

a plurality of compacting shafts with compacting gears proximate to the impeller shafts;

a beverage container sorting system;

a beverage container storage system;

a self-cleaning system configured to clean the mechanical components of the reverse vending machine;

a control system;

a messaging system;

a PLC (programmable logic controller) and associated logic circuits to control the reverse vending machine;

a microprocessor based computer system;

associated arithmetic circuits;

a storage system configured for storing and retrieving data;

a computer operating system;

software means for recording and analyzing data;

a sensor configured to produce beverage container weight data;

computing means for processing beverage container weight data;

computing means for producing appropriate display messages when non-empty beverage containers are present and for controlling the rejection of non-empty beverage containers.

16. A reverse vending machine comprising:

a frame;

a dual level intake chute configured to accept beverage containers;

a plurality of rotating impeller shafts configured with a plurality of protruding impeller arms;

a plurality of compacting shafts with compacting gears proximate to the impeller shafts;

a beverage container sorting system;

a beverage container storage system;

a self-cleaning system configured to clean the mechanical components of the reverse vending machine;

a control system;

a messaging system;

a PLC (programmable logic controller) and associated logic circuits to control the reverse vending machine;

a microprocessor based computer system;

associated arithmetic circuits;

a storage system configured for storing and retrieving data;

a computer operating system;

software means for recording and analyzing data;

a bar code scanner configured to read beverage container bar codes;

computing means for processing beverage container bar codes;

computing means for storing all beverage container processing information including processing time, user ID, bar code data, and coupons selected;

computing means for producing transaction display messages;

computing means for controlling the rejection of beverage containers with non-recyclable, unacceptable, or unrecognizable bar codes.

17. A reverse vending machine comprising:

a frame;

a dual level intake chute configured to accept beverage containers;

a plurality of rotating impeller shafts configured with a plurality of protruding impeller arms;

a plurality of compacting shafts with compacting gears proximate to the impeller shafts;

a beverage container sorting system;

a beverage container storage system;

a self-cleaning system configured to clean the mechanical components of the reverse vending machine;

a control system;

a messaging system;

a PLC (programmable logic controller) and associated logic circuits to control the reverse vending machine;

a microprocessor based computer system;

associated arithmetic circuits;

a storage system configured for storing and retrieving data;

a computer operating system;

software means for recording and analyzing data;

a coupon printer configured to issue coupons to users;

a sensor to produce paper quantity data;

a coupon selection switch assembly;

computing means for controlling the coupon printer;

computing means for processing the paper quantity data;

computing means for producing appropriate display messages when the paper quantity falls below a predetermined threshold.

18. A reverse vending machine comprising:

a frame;

a dual level intake chute configured to accept beverage containers;

a plurality of rotating impeller shafts configured with a plurality of protruding impeller arms;

a plurality of compacting shafts with compacting gears proximate to the impeller shafts;

a beverage container sorting system;

a beverage container storage system;

a self-cleaning system configured to clean the mechanical components of the reverse vending machine;

a control system;

a messaging system;

a PLC (programmable logic controller) and associated logic circuits to control the reverse vending machine;

a microprocessor based computer system;

associated arithmetic circuits;

a storage system configured for storing and retrieving data;

a computer operating system;

software means for recording and analyzing data;

a user ID reader configured to produce user data;

computing means for processing and storing the user ID data.

* * * * *